US006170315B1

(12) United States Patent
Codatto

(10) Patent No.: US 6,170,315 B1
(45) Date of Patent: Jan. 9, 2001

(54) BENDING PRESS FOR MAKING CHANNEL-SHAPED BENDS IN THE EDGES OF A SHEET-METAL PANEL

(76) Inventor: Antonio Codatto, Via Enrico Fermi 17, I-36045 Lonigo (Vincenza) (IT)

( * ) Notice: Under 35 U.S.C. 154(b), the term of this patent shall be extended for 0 days.

(21) Appl. No.: 09/424,668

(22) PCT Filed: May 28, 1998

(86) PCT No.: PCT/EP98/03198

§ 371 Date: Jan. 28, 2000

§ 102(e) Date: Jan. 28, 2000

(87) PCT Pub. No.: WO98/53929

PCT Pub. Date: Dec. 3, 1998

(30) Foreign Application Priority Data

May 29, 1997 (IT) ..... TO97A0464

(51) Int. Cl.[7] ..... B21D 5/04
(52) U.S. Cl. ..... 72/316; 72/323
(58) Field of Search ..... 72/323, 322, 319, 72/316, 478

(56) References Cited

U.S. PATENT DOCUMENTS 4,765,171 * 8/1988 Klingesberger ..... 72/319
5,313,814 * 5/1994 Yamamoto ..... 72/323
5,868,024 * 2/1999 Codatto ..... 72/323

* cited by examiner

*Primary Examiner*—Daniel C. Crane
(74) *Attorney, Agent, or Firm*—Sughrue, Mion, Zinn, Macpeak & Seas, PLLC

(57) ABSTRACT

The movable blank-holder (16) of a bending press comprises a series of sections (26, 28) and a pair of motor-driven carriages (42) each of which has an entraining member (44) which can selectively engage and release the sections (26, 28) in order to move them for re-arrangement purposes. Each of two sections (28) situated at opposite ends of the series comprises a shoe-holder body (48) which supports a respective shoe (50) by means of inclined guides. Each shoe-holder (48) carries a respective slide (56) having a driving portion (60) and each shoe (50) has a driven portion (64). These driving and driven portions have formations (62, 64) cooperating with one another directly with a shaped coupling with a single degree of freedom, arranged in a manner such that movements of the slide (56) are converted into oblique movements of the respective shoe (50) for releasing it from and engaging it with a lateral channel-shaped bend which has already been made in a sheet-metal panel, without sliding on the panel. Each carriage (42) comprises an entraining member (44) and each slide (56) comprises an entrained member (58) which can be engaged by the entraining member (44) in order to move the slide (56) selectively towards the center of the press. The two carriages (42) are movable simultaneously in opposite directions upon command in order simultaneously to bring about the aforementioned movements of the shoes (50), by means of the slides (56).

11 Claims, 6 Drawing Sheets

BENDING PRESS FOR MAKING CHANNEL-SHAPED BENDS IN THE EDGES OF A SHEET-METAL PANEL

This application is a 371 of PCT/EP98/03198, filed May 28, 1998.

The present invention relates to a bending press for making channel-shaped bends in the edges of a sheet-metal panel.

A bending press according to one embodiment described and illustrated in the document WO-96/13346 comprises a pair of carriages movable along its movable blank-holder in order to rearrange its sections. Each of these carriages comprises a first set of teeth fixed to the carriage, an input shaft housed in the shoe-holder body and connected to the first set of teeth by a toothed sprocket, a second set of teeth fixed to the shoe, and gearing for transmitting the drive of the input shaft to the second set of teeth.

This known mechanism enables the movements of the two shoes to be coordinated with the movements of the movable blank-holder, preferably by numerical control, in a manner such that, for movements of the movable blank-holder away from the fixed blank-holder there are corresponding simultaneous movements of the two shoes towards the centre of the press and towards the fixed blank-holder, without sliding of the shoes on the sheet metal. The two shoes are returned to the position to which they are moved away from the centre of the press by means of respective spiral springs or equivalent means incorporated in the shoe-holder body and interposed between it and the input shaft of the mechanism.

The mechanism according to the document WO-96/13346 represented considerable progress in comparison with the prior art but has the disadvantage of being expensive because of the precision required in the manufacture and assembly of its components, particularly of its sets of teeth and its toothed sprockets.

The object of the invention is to provide a bending press of the type in question in which the function of controlling the movements of the shoes is performed by much simpler and more inexpensive means.

In a press according to the invention, the devices which transmit the movement of the carriages to the shoes in order to move them near to the centre of the press and near to the fixed blank-holder, that is, in order to release them from the channel-shaped bends without sliding on the sheet metal, do not comprise toothed members requiring very precise manufacture. As will be understood better from a reading of the detailed description given with reference to the drawings, according to the invention, these devices comprise very simple elements which operate by pressure and by relative sliding; even though the cooperating surfaces of these elements require a certain precision of manufacture, this precision does not involve such high costs as the manufacture of teeth.

Figure 1:
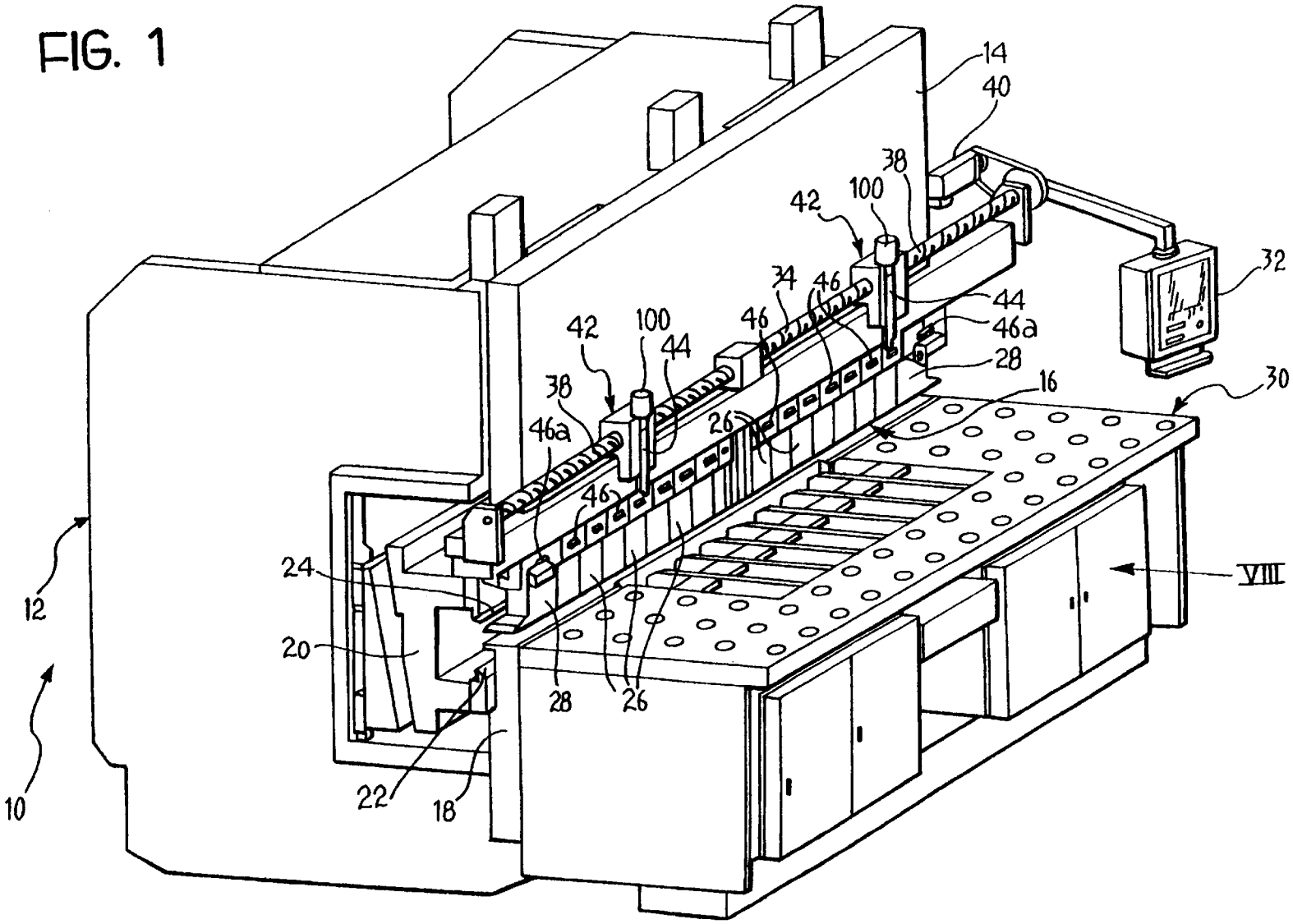
Figure 2:
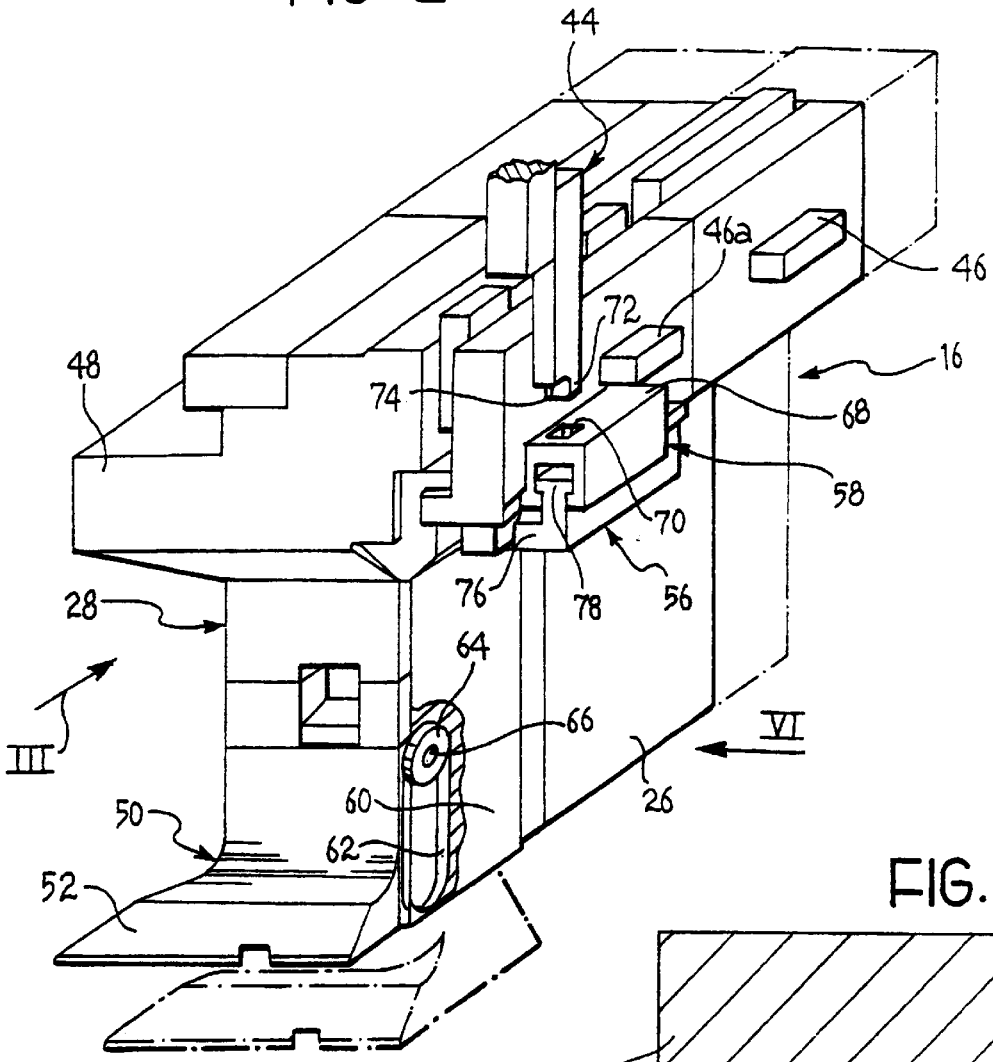
Figure 4:
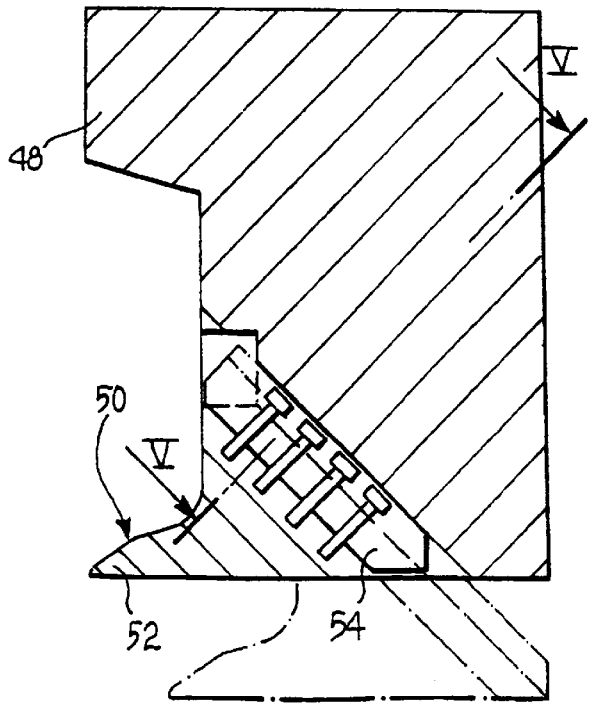
Figure 5:
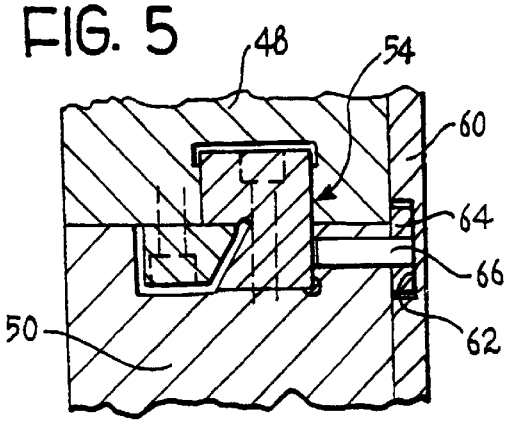
Figure 3:
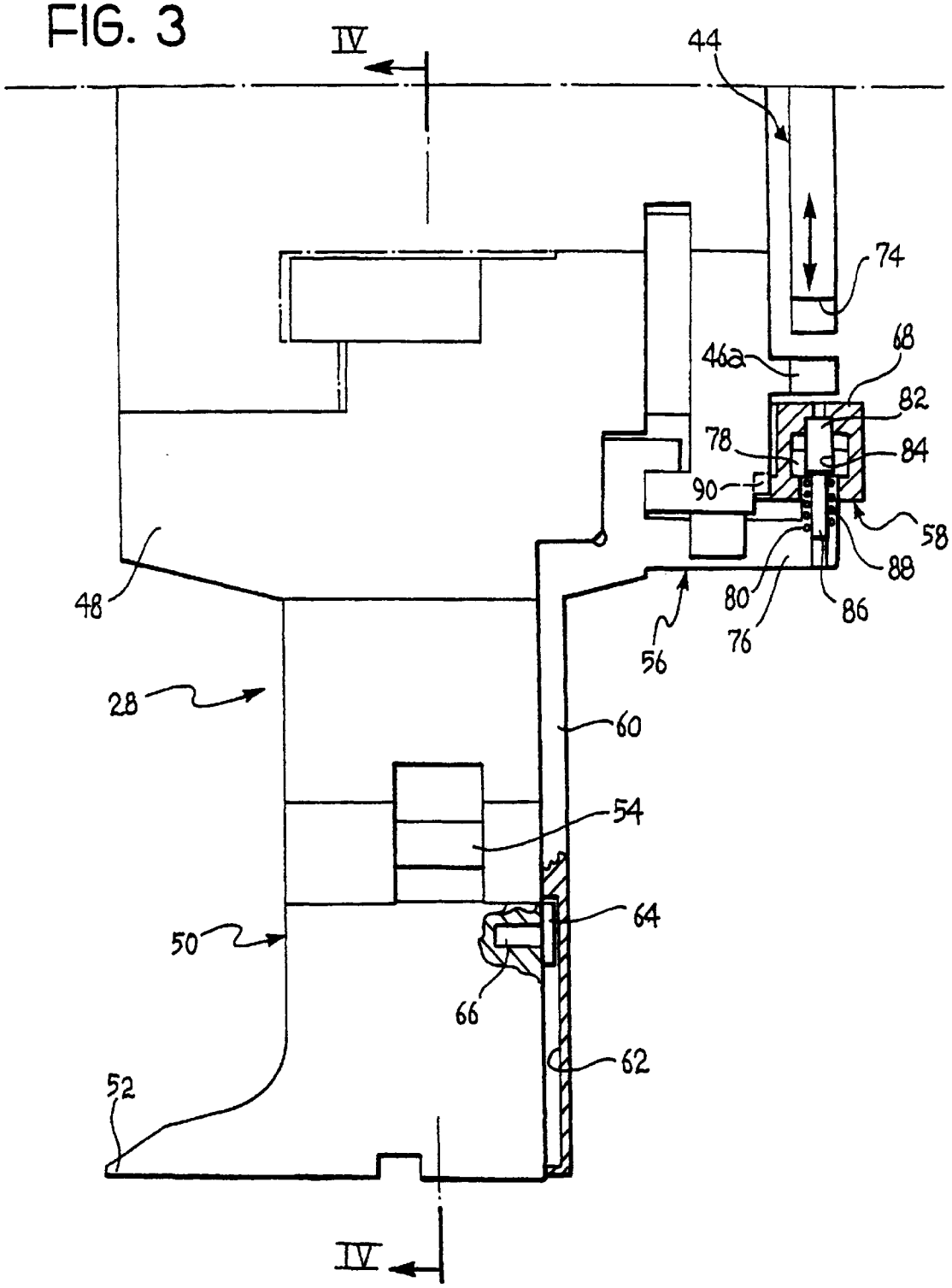
Figure 6:
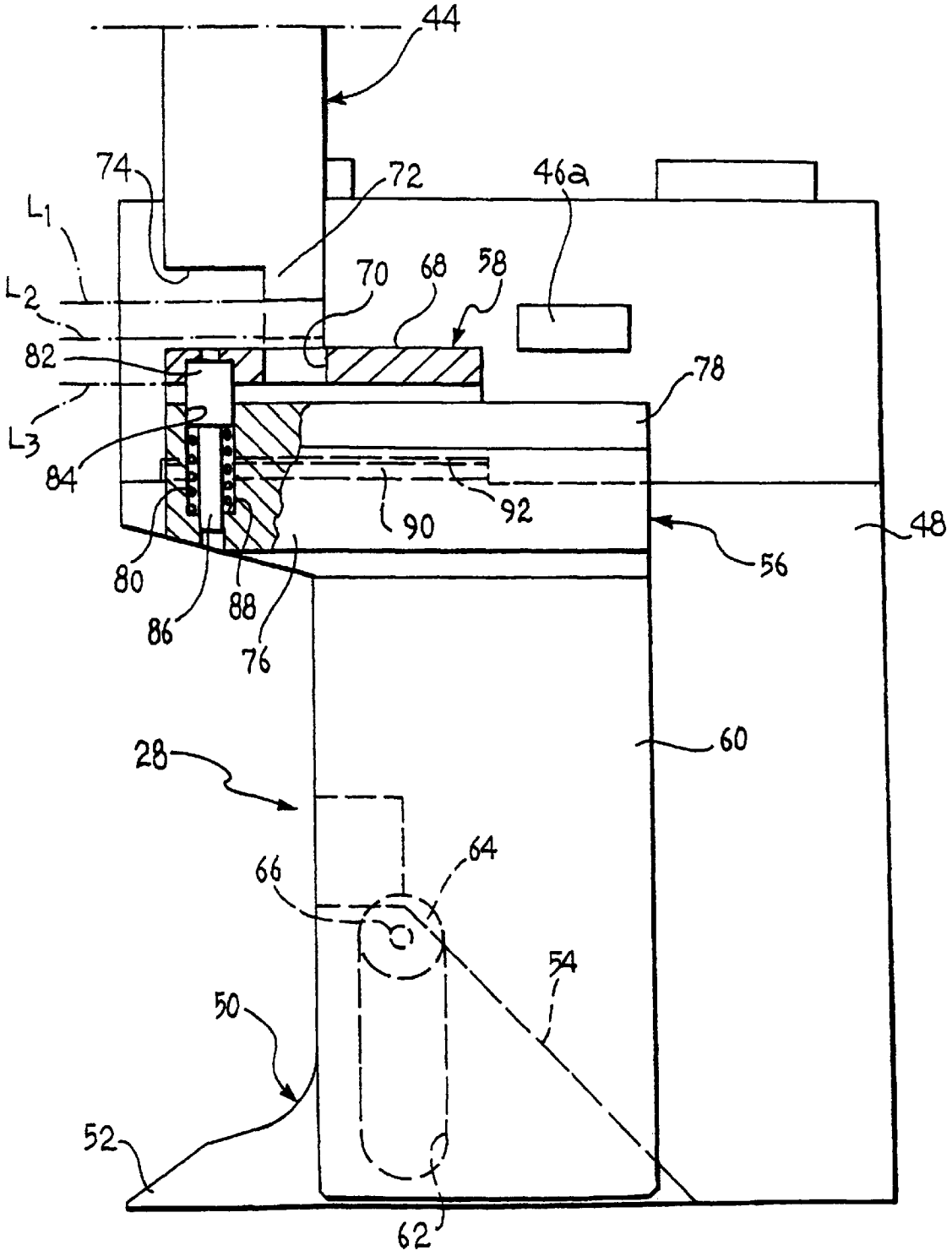
Figure 7:
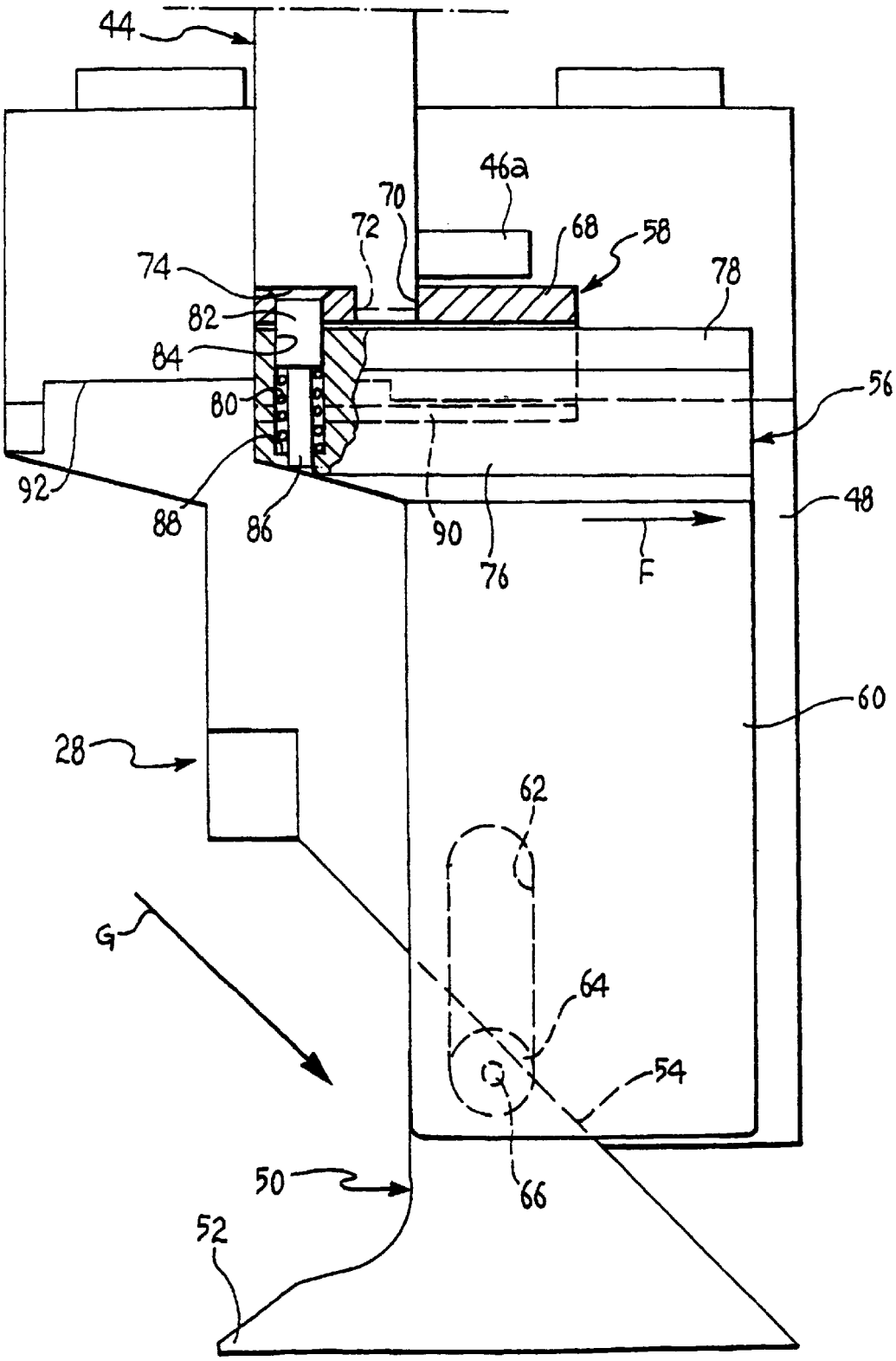
Figure 8:
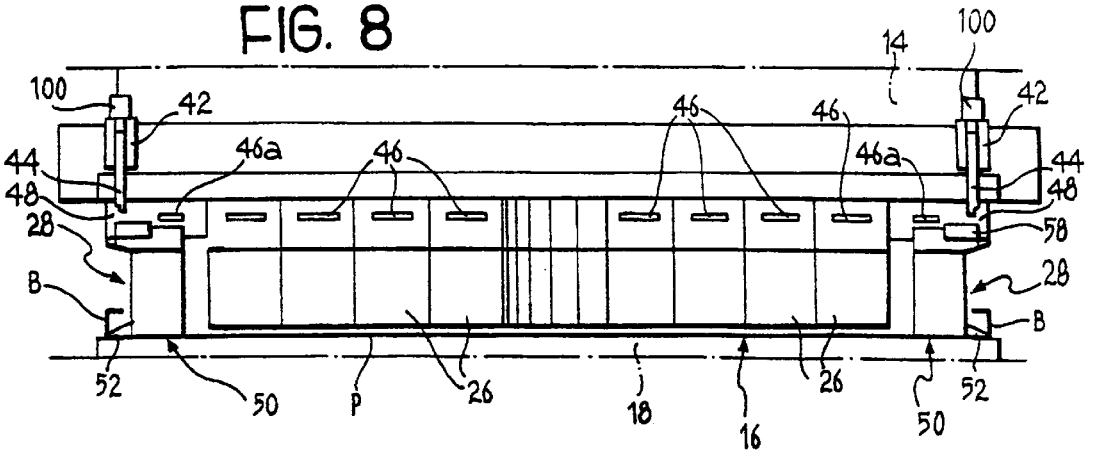
Figure 9:
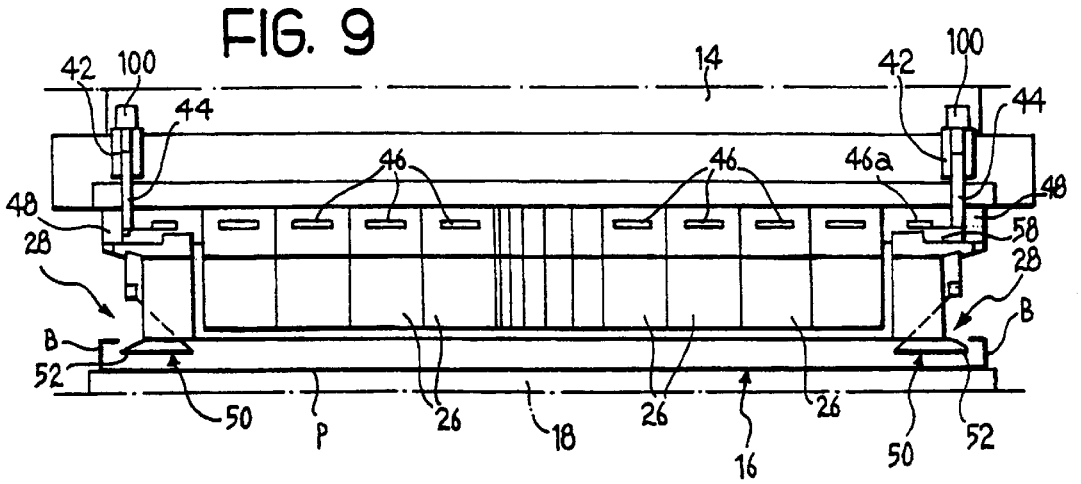
Figure 10:
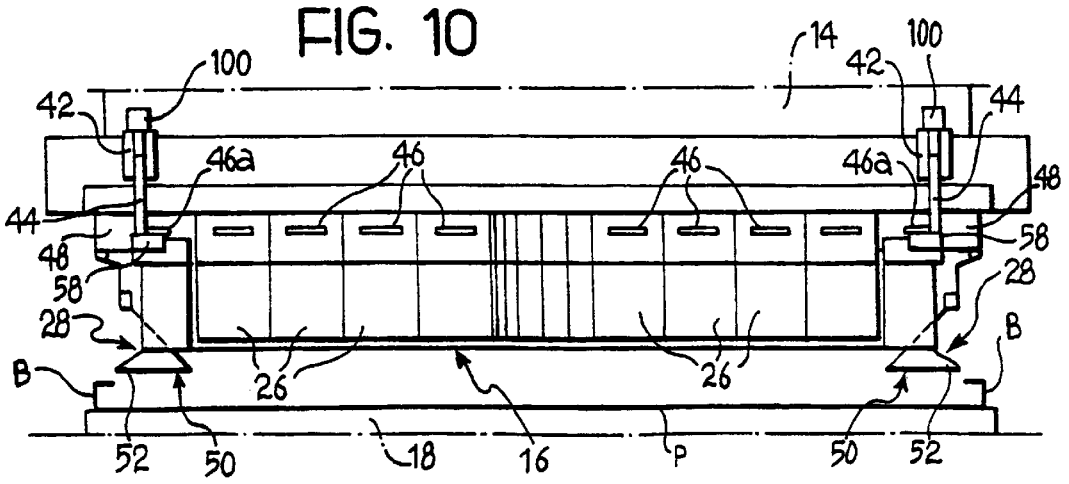

The invention will be understood better from a reading of the following detailed description with reference to the appended drawings, given by way of non-limiting example, in which:

FIG. 1 is a schematic, perspective view of a bending press to which the invention is applied, FIG. 2 is a perspective view of an end region of the movable blank-holder of the press of FIG. 1, on an enlarged scale, including one of the two shoe/shoe-holder units (the left-hand one closer to the observer in FIG. 1, it being understood that the other shoe/shoe-holder unit is formed as mirror image thereof), FIG. 3 is a partially-sectioned side elevational view taken on the arrow III of FIG. 2, FIG. 4 is a section taken in the plane indicated IV—IV in FIG. 3, FIG. 5 is a section of a detail, taken on the line V—V of FIG. 4, FIGS. 6 and 7 are front elevational views taken on the arrow VI of FIG. 2, with certain parts shown in broken outline since they are masked in these drawings, and with certain parts cut away, showing the shoe of the unit in the position to which it is moved away from the centre of the press and from the fixed blank-holder, and in the position to which it is moved near to the centre of the press and near to the fixed blank-holder, respectively, and FIGS. 8, 9 and 10 are partial schematic front views taken on the arrow VIII of FIG. 1 showing three successive stages of the release of the movable blank-holder of the press and of its shoes from a sheet-metal panel two opposite edges of which already have channel-shaped bends.

The embodiment shown in the drawings relates to the most common case of a press in which the movable blank-holder is the upper one, the fixed blank-holder is the lower one, and the plane of the sheet-metal panel subjected to bending is horizontal.

The invention is not limited to this arrangement, however, since, by virtue of the fact that the movements of the shoes are brought about positively, it can be applied to other arrangements such as, for example, an arrangement in which the movable blank-holder is the lower one, or an arrangement in which the plane of the sheet-metal panel is vertical and the movable blank-holder moves horizontally.

With reference to FIG. 1, a vertical bending press, generally indicated 10, comprises a strong C-shaped framework, generally indicated 12.

A strong front plate 14 is slidable vertically on an upper front portion of the framework 12 and its lower portion carries an upper movable blank-holder, generally indicated 16, which will be referred to further below.

Upward and downward vertical movements of the front plate 14 and of the blank-holder 16 are brought about by one or more hydraulic actuators, not shown.

A lower front portion of the framework 12 carries a fixed blank-holder 18 with which the movable blank-holder 16 cooperates during bending operations.

A blade-holder 20 which is also C-shaped is mounted in the cavity defined by the C-shape of the framework 12 and carries a pair of bending blades, that is, a lower blade 22 and an upper blade 24.

The blade-holder 20 can be moved upwards and downwards and can also be advanced and retracted under the control of actuators which are preferably numerically controlled, to cause selective cooperation of its lower blade 22 with the upper blank-holder 16 or of its upper blade 24 with the lower blank-holder 18.

For further details relating to the blade-holder 20 and to its control actuators, reference should be made to international patent application No. PCT/EP98/02163 filed on Apr. 14, 1998 for "A sheet-metal bending press".

The upper movable blank-holder 16 is of the sectional type formed by a series of sections 26, for example, as in the bending presses described and illustrated in the documents U.S. Pat. No. 4,089,198 and WO-96/13346.

The series of sections 26 comprises two special sections, indicated 28, which are spaced apart so as to correspond to opposite side edges of a sheet-metal panel. In FIGS. 1, 2 and 8 to 10, these sections 28 are arranged at the two ends of the series of sections, that is, in positions corresponding to the maximum usable width of the press.

As shown in FIG. 1, on the front of the press 10 there is a table 30 for supporting sheet-metal panels being bent. The table 30 is preferably served by a manipulator (not shown).

All of the movements of the press and of its manipulator are preferably controlled by a numerical control device, conventionally indicated by means of a suspended "console" 32 thereof.

A translation bar 34 extending along the movable blank-holder 16 comprises two portions 38 which are threaded in opposite directions.

The bar 34 can be rotated selectively by a numerically-controlled electric motor 40.

The two portions 38 of the bar 34 which are threaded in opposite directions carry respective carriages 42 coupled to these threaded portions by means of respective female threads, not shown. The two carriages 42 are provided for rearranging the sections 26 and 28 of the movable blank-holder 16 each time such rearrangement is necessary in order to adapt the blank-holder 16 to the width of a specific sheet to be bent.

With reference to FIGS. 1, 2, 6, 7 and 8 to 10, in order to perform these operations to rearrange the sections 26 and 28, each carriage 42 has a respective entraining member 44, further details of which will be given below.

For the moment, it will suffice to state that an upper portion of each of the sections 26 has a respective entrained member constituted by a front projection 46 which can be engaged by a respective entraining member 44.

Further details of the entraining members 44, of the entrained members 46, and of their cooperation will be given below. For the moment it will suffice to state that the left-hand carriage 42 of FIGS. 1 and 8 to 10 is arranged for moving sections 26 and 28 situated to the left of the centre of the press and the right-hand carriage 42 with its entraining member 44 is arranged for simultaneously moving right-hand sections 26 in the opposite direction.

With reference to FIGS. 2 to 4 and 6 to 10, each end section 28 comprises a shoe-holder body 48 which acts as the actual section and has, for its rearrangement by the respective carriage 42, an entrained member 46*a* in the form of a front projection just like the projections 46 and aligned therewith.

Each body 48 supports a shoe 50 with a lower beak-like projection 52.

As can be seen, for example, in FIGS. 8 to 10, the projections 52 of each shoe 50 extend in opposite directions so that each can be engaged in a lateral channel-shaped bend, indicated B, which has already been made in a sheet-metal panel P.

Each shoe 50 is supported by its body 48 by means of inclined guides 54, preferably oriented at 450 to the plane of the sheet-metal panel P (FIGS. 8 to 10) to be bent.

The cross-section of the guides 54, which is similar to a dovetail, is visible in FIG. 5.

Each shoe 50 can be moved along the guides 54 between a working or engagement position, shown in continuous outline in FIGS. 2 and 4 as well as in FIG. 6, and a release position, shown in broken outline in FIGS. 2 and 4, as well as in FIG. 7.

Means which, in accordance with a preferred embodiment of the invention, serve for converting the movements of the carriages 42 along the translation bar 34 into corresponding movements of each shoe 50 from the working position to the release position, as well as their return from the release position to the working position, will now be described with reference to FIGS. 2 to 7.

Each shoe-holder body 48 carries a respective slide 56 slidable on the body 48 in directions parallel to the directions of movement of the carriage 42.

An abutment in the form of a block 58, the function of which will be referred to further below, is fitted on the slide 56.

A driving portion 60 in the form of a strong, vertically elongate plate-like portion is fixed to the slide 56. The plate-like portion 60 is fitted flat on a front face of the shoe-holder body 28, is substantially coplanar with the front faces of the sections 26, and faces the shoe 50.

The plate-like portion 60 has a slot 62 which has parallel sides and a blind base, and which is open towards the shoe 50.

In the embodiment shown in detail in FIGS. 2, 6 and 7, the slot 62 extends in the direction of movement of the movable blank-holder (vertically in the embodiment considered) and perpendicular to the direction of movement of the slide 56.

The shoe 50, for its part, has a feeler member 64 in the form of a wheel rotatable on a pin 66 fixed to the shoe 50.

The slot 62 constitutes a linear guide for the feeler wheel 64 which is engaged directly with precision with both sides of the slot 62. In other words, the slot 62 and the feeler wheel 64 cooperate with one another with a shaped coupling.

By virtue of this shaped coupling with a single degree of freedom between the sides of the slot 62 and the wheel 64, a movement of the slide 56 towards the centre of the press is converted into an oblique movement of the respective shoe 50 in the direction towards the centre of the press and the fixed blank-holder, along the respective inclined guide 54, that is, from the position of FIG. 6 to that of FIG. 7; conversely, a movement of the slide 56 in the direction away from the centre of the press is converted into an oblique movement of the respective shoe 50 in the direction away from the centre of the press and from the fixed blank-holder along the respective inclined guide 54, that is, from the position of FIG. 7 to that of FIG. 6.

These movements are controlled positively by the respective carriage 42 in the manner which will be explained below. In FIGS. 2, 6 and 7, the slot 62 has been shown extending vertically but it could also extend slightly obliquely (downwards towards the right in FIGS. 6 and 7) to achieve a larger horizontal component (parallel to the blank-holder) of the travel of the shoe 50.

The formation of the slot 62 with a blind base has the advantage of keeping its sides and the wheel 64 protected from knocks and dirt. Moreover, since, as shown in FIGS. 2, 6 and 7, the slot 62 is very close to the edge of the plate-like portion 60 situated farthest from the centre of the press (the left-hand edge in FIGS. 2, 6 and 7), the presence of the blind base has the advantage of not weakening the plate-like portion 60.

With reference to FIGS. 2, 3, 6 and 7, the block 58 has a prismatic shape with a substantially inverted U-shaped cross-section.

The block 58 has a square engagement seat 70 in an upper wall 68.

The entraining member 44 which is intended to cooperate with the block 58 is in the form of a bar slidable vertically, that is, in the direction of movement of the movable blank-holder 16, on the respective carriage 42.

At its lower end, the bar 44 has a square projecting nib 72 which can be engaged in the seat 70 in order to entrain the block 58 and the respective slide 56 in the manner which will be explained further below.

Beside the nib 72 of the bar 44 there is a reaction face 74 facing towards a corresponding reaction face constituted by the upper wall 68 of the block 58.

The block 58 is supported by a bracket 76 with a dovetail-shaped head 78 forming part of the slide 56.

The block 58 is movable on the bracket 76 in the vertical direction of movement of the movable blank-holder 16 and is biased towards the bar 44 by resilient return means.

As shown in FIGS. 3, 6 and 7, these resilient return means are preferably in the form of a helical compression spring 80.

A cylindrical pin 82 is fixed in the upper wall 68 of the block 58 in alignment with the reaction face 72 of the bar 44 and projects towards the head portion 78 of the bracket 76.

In the region of the pin 82, the head portion 78 has a cylindrical hole 84 in which the pin 82 is engaged permanently and slidably in order to keep the block 58 always connected to the slide 56 when the latter is caused to translate.

The pin 82 constitutes the head of a mushroom-shaped element with a shank 86 which extends concentrically in the hole 84 in order to locate the return spring 80.

In the embodiment shown, the return spring 80 is interposed between the pin 82 and an annular base wall 88 of the hole 84.

The block 58 has a key-like portion 90 which projects towards the shoe-holder body 48 from a flange of the block 58 facing this body.

The shoe-holder body 48, for its part, has a downwardly open recess 92 for housing the key-like portion 90.

The arrangement is such that, when the slide 56 is in the position farthest from the centre of the press (FIG. 6), the movable block 58 is kept raised in a locking position by the spring 80 and its key-like portion 90 is engaged in the recess 92.

The key 90 and the recess 92 thus constitute means for locking the slide 56 and the shoe 50 in the working position of FIG. 6, ensuring that the shoe 50 cannot move from this position during bending operations.

The locking means can be released upon command to allow the shoe 50 to move from the working position of FIG. 6 to the release position of FIG. 7.

The arrangement is such that, when the block 58 is lowered against the force of the spring 80, its key-like portion 90 is released from the recess 92 whilst the pin 82 engaged in the hole 84 keeps the block 58 and the slide 56 fixed together, enabling the slide 56 to move towards the centre of the press and the shoe 50 correspondingly to move from the working position of FIG. 6 to the release position of FIG. 7.

With reference to FIGS. 1 and 8 to 10, the top of each bar 44 is connected to the rod of a respective linear actuator 100, which is preferably numerically controlled.

The actuator 100 can move the bar 44 between a position in which it is raised, that is, retracted relative to the fixed blank-holder 18, an intermediate position, and a position in which it is lowered, that is, advanced relative to the fixed blank-holder 18.

In FIG. 6, the level of the nib 72 of the bar 44 in the retracted position is indicated Li, the level of the nib 72 in the intermediate postion is indicated L2, and its level in the advanced position is indicated L3.

When the bar 44 is retracted, its nib which is at the level L1 is above all of the projections or entrained members 46, 46*a* and any movements of the carriage 42 have no effect.

When the bar 44 is in the intermediate position with its nib at the level L2, its sides are in a position such that they interfere with the projections 46, 46*a* and the sections 26, 28 can be re-arranged, by means of the movements of the carriage 42, by virtue of the engagement of the bar 44 with lateral pressure with the selected projection 46 or 46*a*.

In order to bring about the movements of the shoes from the working position of FIG. 6 to the release position of FIG. 7, the bars 44 of the two carriages 42 are brought to the advanced position in which their nibs 72 have moved down to the level L3 and each is engaged in the seat 70 of the corresponding block 58, as shown in FIG. 7. In these conditions, the pressure of the reaction faces 74 against the respective blocks 58 has lowered the latter against the force of their return springs 80 with consequent release of the key-like portions 90 from the respective recesses 92.

In these conditions, a movement of the carriage 42 towards the centre of the press in the direction of the arrow F of FIG. 7 is converted into a corresponding movement of the slide 56, by virtue of the engagement of the nib 72 in the seat 70.

During this movement, the laterally outer side of the slot 62 (the left-hand side in FIGS. 6 and 7) exerts on the wheel 64 a force directed towards the centre of the press (towards the right in FIGS. 6 and 7).

By virtue of the inclined guides 54, the cooperation of the laterally outer side of the slot 62 is translated into an oblique movement of the shoe 50 in the direction of the arrow G of FIG. 7, during which the wheel 64 runs down along the slot 62.

The arrangement is such that, when the shoe 50 reaches the release position of FIG. 7, the laterally inner side (the right-hand side in FIG. 7) of the bar 44 strikes the projection 46*a* which constitutes a travel-limit stop.

As will be understood, the shoe 50 is returned from the release position of FIG. 7 to the working position of FIG. 6 by a movement of the carriage 42 in the direction away from the centre of the press with the nib 72 engaged in the seat 50 and with the block 58 urged downwardly against the force of its spring 80.

Reference will now be made to FIGS. 8, 9 and 10 to describe the coordinated sequence of movements of the blank-holder 16 and of its end shoes 50, both of which movements are preferably controlled by the numerical-control device 32 of FIG. 1.

In FIG. 8, the sheet-metal panel P is pinched between the upper blank-holder 16 and the lower blank-holder 18. The two shoes 50 are in their respective working positions of FIG. 6 in which they have been moved apart and away from the centre of the press and their beak-like projections 52 are engaged in the respective lateral bends B in the panel P.

With reference to FIG. 9, in order to be able to release the panel P from the press, the numerical control device 32 (FIG. 1) brings about the upward movement of the movable blank-holder 16 and, at the same time, the oblique movement of the two shoes 50 in the direction of the arrow G of FIG. 7, towards their release positions. The coordination of the movements is such that, as soon as the movable blank-holder 16 is separated from the panel P, the shoes 50 also start to move in the direction of the arrow G of FIG. 7 and are separated from the panel P so that they never slide on the panel.

FIG. 10 shows the final position in which the movable blank-holder 16 is raised and the shoes 50 are closest together having reached the final release position of FIG. 7. In this position, the projections 52 no longer interfere with the bends B.

When the upper blank-holder 16 is lowered against a panel P for bending, the movements of the blank-holder 16 and of the shoes 50, which are coordinated by the numerical-control device 32 of FIG. 1, take place in the opposite directions, again without sliding of the shoes 50 on the panel P, as a result of the movement of the carriages 42 away from the centre of the press with the nibs 72 of the bars 44 engaged in the seats 70 of the blocks 58.

FIG. 1 shows a bending press which comprises a pair of blades cooperating with respective counterblades forming part of respective blank-holders.

The invention may, however, be applied to a press even having only one pair of bending tools (blade and counterblade), in particular in order to make one or more bends in an edge of a sheet-metal panel in a direction perpendicular to that of the opposed channel-shaped bends indicated B in FIGS. 8 to 10.

What is claimed is:

1. A bending press for making at least one bend in an edge of a sheet-metal panel of which at least one lateral edge perpendicular to the edge to be bent has already been bent into a channel-shape, of the type comprising a pair of opposed blank-holders, that is, a movable blank-holder (16) and a fixed blank-holder (18), and at least one bending blade (22) cooperating with the movable blank-holder (16), in which:

the movable blank-holder (16) comprises a series of sections (26, 28) movable along the movable blank-holder and equipped with a pair of motor-driven carriages (42) also movable in a direction along the movable blank holder and each of which has an entraining member (44) which can selectively engage and release the sections (26, 28) in order to move them for rearrangement purposes, each of two sections (28) situated at opposite ends of the series comprises a shoe-holder body (48) which supports a respective shoe (50) by means of inclined guides (54) converging towards the fixed blank-holder (18), the two shoes (50) have projections (52) pointing in opposite directions for engagement in respective channel-shaped bends (B) which have already been made, and each carriage (42) can bring about a movement of a respective shoe (50) along its inclined guides (54), characterized in that each shoe-holder body (48) carries a respective slide (56) movable parallel to the direction of movement of the respective carriage (42), each slide (56) has a driving portion (60) and each shoe (50) has a driven portion (64), the driving and driven portions having formations (62, 64) cooperating with one another directly with a shaped coupling with a single degree of freedom and arranged in a manner such that a movement of the slide (56) towards the centre of the press is converted into an oblique movement of the respective shoe (50) in the direction towards the centre of the press and towards the fixed blank-holder (18) along the respective inclined guide (54) and, conversely, a movement of the slide (56) away from the centre of the press is converted into an oblique movement of the respective shoe (50) in the direction away from the centre of the press and from the fixed blank-holder (18) along the respective inclined guide (54), each carriage (42) comprises an entraining member (44) and each slide (56) comprises an entrained member (58) which can be engaged by the entraining member (44) of the respective carriage (42) in order to move the slide (56) selectively towards the centre of the press (10) and in the opposite direction, the two carriages (42) are movable simultaneously in opposite directions upon command in order simultaneously to bring about the aforementioned movements of the shoes (50) by means of the slides (56), and each shoe-holder body (48) and the respective slide (56) have cooperating mutual locking means (90, 92) for restraining the slide in the position to which it is moved away from the centre of the press, these locking means (80, 82) being releasable upon command to allow the slide (56) to move towards the centre of the press.

2. A bending press according to claim 1, characterized in that the driving portion is constituted by a plate-like portion (60) projecting from the carriage, facing the shoe (50), and having, by way of cooperating formation, a linear guide (62) with parallel sides which extend substantially in the direction of movement of the movable blank-holder (16) and perpendicular to the direction of movement of the slide (56), and the driven portion is constituted by a feeler member (64) fixed to the shoe (50), housed in the guide (62), and engaged with both of the side walls of the guide (62).

3. A bending press according to claim 2, characterized in that the feeler member is in the form of a wheel (64) rotatable on a pin (66) fixed to the shoe (50).

4. A bending press according to claim 2, characterized in that the linear guide is in the form of a slot (62) with a blind base formed in the plate-like portion (60) and open towards the shoe (50).

5. A bending press according to claim 1, characterized in that each carriage (42) comprises a single entraining member (44) for selectively moving the sections (26, 28) for rearrangement purposes and for engaging the entrained member (58) of a respective slide (56) with a shaped coupling in order to move it towards the centre of the press (10) and in the opposite direction.

6. A bending press according to claim 5, characterized in that the entraining member of each carriage (42) is constituted by a bar (44) extending in the direction of movement of the movable blank-holder (16) and movable by a respective actuator (100) in this direction between a position (L1) in which it is retracted relative to the fixed blank-holder (18), an intermediate position (L2), and a position (L3) in which it is advanced relative to the fixed blank-holder (18), in that each section (26, 28) has a first front projection (46) which can be engaged laterally by the bar (44) for the purposes of rearrangement of the sections (26, 28), in that each slide (56) has a second front projection (58) having an engagement seat (70) in which a corresponding end (72) of the bar (44) of the respective carriage (42) can engage for the purpose of movement of the slide (56) in the said two directions, and in that the arrangement of the bar (44) and of the projections **(46, 46*a*, 58) is such that, in its intermediate position (L2), the bar (44) can engage only the projections (46, 46*a*) of the sections (26, 28), including the projection (46*a*) of the respective shoe-holder body (28) and, in the advanced position (L3), the said end (72) of the bar (44) can engage in the seat (70) of the projection (58) of the respective slide (56)**.

7. A bending press according to claim 6, characterized in that:

the second front projection is in the form of a movable block (58) carried by the slide (56), movable in the direction of movement of the movable blank-holder (16) and biased towards the bar by resilient repulsion means (80) to a position in which the slide (56) is locked relative to the shoe-holder body (48), the block (58) has a key-like portion (90) and the shoe-holder body (28) has a recess (92) in which the key-like portion (90) is engaged when the block (58) is in the locking position and when the slide (56) is in the position to which it is moved away from the centre of the press, the key-like portion (90) and the recess (92)

constituting the said locking means which can be released upon command, the block (58) has an engagement seat (70) in a reaction face (68) of the block facing the bar (44) and the bar (44) has a nib (72) which can be engaged in the seat (70) in order to achieve the said shaped coupling as a result of the movement of the bar (44) to the advanced position (L3), the bar (44) has a reaction face (74) which is disposed beside the nib (72) and which, during the movement of the bar (44) to the advanced position (L3), engages the reaction wall (68) of the block in order to urge the block (58), against the force of its resilient repulsion means (80), to a release position in which the key-like portion (90) is released from the recess (82) of the shoe-holder body (48) to allow the slide (56) to slide relative to the shoe-holder body (48), and restraining means (82, 84) are provided for fixing the slide (56) and the shoe-holder body (48) for translation together when the key-like portion (90) is released from the respective recess (92).

8. A bending press according to claim 7, characterized in that the restraining means comprise a pin (82) fixed to the movable block (58) and a hole (84) in the slide (56), in which the pin (82) is engaged slidably.

9. A bending press according to claim 8, characterized in that the resilient repulsion means of the block are constituted by a helical compression spring (80) interposed between the pin (82) and a base wall (88) of the hole (84) for housing the pin (82).

10. A bending press according to claim 6, characterized in that, when the slide (56) is in the position farthest from the centre of the press (10), its front projection (58) is farther from the centre than the projection **(46*a*) of the shoe-holder body (28) and the projection (46*a*) of the shoe-holder body (28) is arranged in a manner such as to constitute, in the direction in which the movable blank-holder (16) extends, a lateral travel-limit abutment for the bar (44) in the position of the slide (56) which corresponds to the position to which the shoe (50) is moved near to the fixed blank-holder (18) and near to the centre of the press (10)**.

11. A bending press according to claim 6, characterized in that the bending press comprises a threaded translation bar (34) extending along the movable b ank-holder (16) and having two portions (38) threaded in opposite directions and coupled with respective female threads of the respective carriages (42) and a numerically-controlled electric motor (40) for rotating the threaded bar (34), in that each carriage (42) carries a numerically-controlled actuator (100) for moving the respective bar (44), and in that the bending press comprises a numerical-control unit (32) which controls the said motor (40) and the said actuators (100) in coordination with the means for controlling the movable blank-holder (16) in a manner such that, for movements of the movable blank-holder (16) away from and near to the fixed blank-holder (18), there are respective corresponding movements of the shoes (50) towards one another and apart, without sliding of the shoes on the sheet-metal interposed between the two blank-holders (16, 18).

* * * * *